United States Patent [19]

Stephan

[11] Patent Number: 4,648,753

[45] Date of Patent: Mar. 10, 1987

[54] ROCK-BOLT STABILIZER DEVICE FOR MINING AND TUNNELING APPLICATIONS

[75] Inventor: Peter Stephan, Essen, Fed. Rep. of Germany

[73] Assignee: Bergwerksverband GmbH, Essen, Fed. Rep. of Germany

[21] Appl. No.: 727,026

[22] Filed: Apr. 25, 1985

[30] Foreign Application Priority Data

May 10, 1984 [DE] Fed. Rep. of Germany ..... 3417252

[51] Int. Cl.[4] ..... E21D 21/02

[52] U.S. Cl. ..... 405/260; 405/261; 411/8

[58] Field of Search ..... 405/259, 260, 261, 262; 411/2, 8, 9

[56] References Cited

U.S. PATENT DOCUMENTS

| | | | |
|---|---|---|---|
| 3,379,016 | 4/1968 | Williams | 405/260 |
| 3,650,112 | 3/1972 | Howlett et al. | 405/260 |
| 4,056,036 | 11/1977 | Kamann et al. | 405/259 X |
| 4,124,983 | 11/1978 | Weatherby | 405/260 |

OTHER PUBLICATIONS

Preface to 2nd English Edition of "Anchoring in Rock and Soil", (Author: Leos Hobst).

Excerpts from "Rock Bolting: A Practical Handbook", (Norwegian Institute of Rock Blasting Techniques).

Excerpts from "Tunnel Engineering Handbook", (Van Nostrand Reinhold Company Inc.).

*Primary Examiner*—David H. Corbin

*Attorney, Agent, or Firm*—Karl F. Ross; Herbert Dubno

[57] ABSTRACT

A rock bolt stabilizer device which can be arranged in boreholes for stabilizing rock and similar host environments in mining and tunneling. The device is adapted to perform the function of a rigid profile anchor under predetermined stress conditions, and is also adapted to perform the function of an expansion anchor under given stress conditions. The device generally comprises an anchor member with mix end which can be secured near the base of the respective borehole by means of a cementitious composition. For tensioning, the other end of the anchor member can carry a bearing plate, a spacer, and a fastener for tensioning. The device also includes a sleeve which performs the function of a rigid anchor, and the sleeve substantially surrounds the anchor member. An increased armoring and anchoring efficiency is achieved with the device.

10 Claims, 1 Drawing Figure

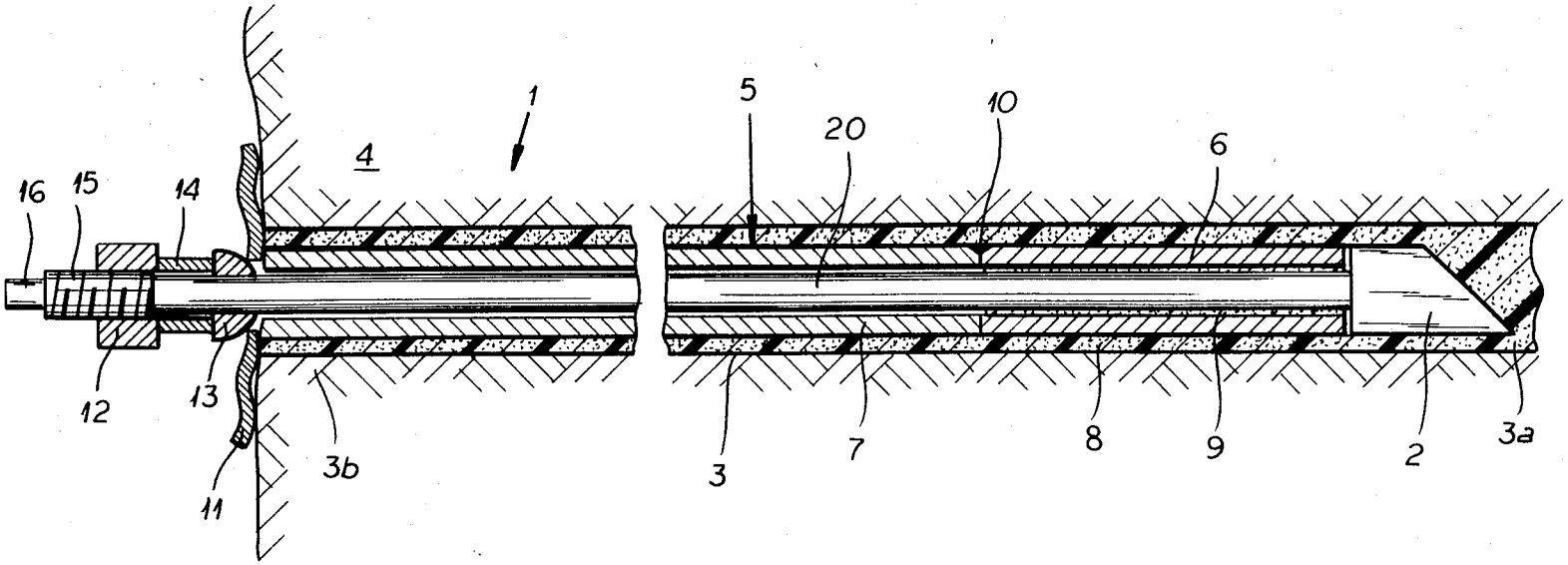
3a
2
6
9
8
10
7
20
5
3
1
4
3b
11
13
14
12
15
16

ROCK-BOLT STABILIZER DEVICE FOR MINING AND TUNNELING APPLICATIONS

FIELD OF THE INVENTION

My present invention relates to a stabilizer device and, more particularly, to a stabilizer, rock anchor, rock bolt or similar means for use in mining, tunneling and the like.

BACKGROUND OF THE INVENTION

Rock bolts are principally used in mining and tunneling.

A rock bolt generally is introduced into a borehole and may be grouted in place, an end of the anchor extending out of the hole and being threaded to accommodate a nut which is braced against a bearing plate.

The grouting may be any hardenable mass, e.g. a synthetic resin and usually a two-component synthetic resin which can be provided in a cartridge which is disrupted by the insertion of the anchor. The latter may be rotated to mix the two components and then is merely permitted to be locked in place in the hardening mass.

A rigid rock bolt, anchor or similar stabilizer provides for reinforcement of the rock or other structure due to the low yielding properties or characteristics of the anchor, and in conjunction with a full grouting because of the strong bond with the rock. The reinforcement action is, however, reduced or eliminated when stress-release movements arise i.e. expansion or contraction or shifting sets in to crack the structure around the anchor However, one constantly has to expect stress-release or stress-shifting movements of the rock, particularly in the case of underground mining or tunneling. When these movements occur the anchors lose their value, and use must be made of expansion or yielding types of rock bolts or anchors to compensate for such movement. This latter type of anchor allows adaptation of the so-called rock armoring to movements of the surrounding rock matter or the like environment, due to the definable expansion or tensile properties of the rock bolt.

Such adaptation to the respective movements of the host environment or rock is only then feasible with an anchor rod when it is made of a material which has corresponding elastic, expanding or, in the most general sense, yielding properties. For this adaptation, furthermore, the anchor rod is securely clamped in place or tensioned at the toe end of the borehole by being securely cemented at the base of the borehole. Such affixing of the anchor is also done at the borehole mouth. However, to permit the extension or accommodation movement of the anchor, at least a portion of its length must be allowed free play in the borehole.

It is known to secure or safeguard the distance of free play or movement of an extensible anchor, whereby the anchor is equipped with a flexible hose-like compensating or slip tube or sleeve which extends between the fixed regions of the anchor in the base of the borehole and in the vicinity of the borehole mouth. The anchor rod is otherwise securely cemented into the borehole over the respective full length, e.g. by hydraulic cement or synthetic resin grout or similar compositions. Utilization of a slip element enhances the extensibility of the anchor in the region where the free play is permitted.

It is a disadvantage of the known anchor that it does not provide a sufficiently high reinforcement of the surrounding rock because of the nature of this sleeve and the surface configuration thereof.

OBJECTS OF THE INVENTION

It is therefore the principal object of the invention to provide an improved stabilizer which substantially precludes the disadvantages of hitherto known rock anchors as described.

It is also an object of my invention to provide a substantially dual purpose anchor which possesses the yielding characteristic of an extensible anchor but the high reinforcement capabilities of a rigid anchor after curing or hardening of the adhesive and hole-filling composition.

It is further an object of my invention to provide a combination or dual purpose anchor which exhibits the characteristics of an expansion type anchor when the predetermined support capacity, loading force or limit has been exceeded, and the initial rigid armoring effect is replaced by the function of the extensible anchor.

SUMMARY OF THE INVENTION

These objects are attained in accordance with the invention in that the anchor member is surrounded over its full length, but excepting the mixing toe end which is fashioned as a mixing or form element (e.g. a cartridge piercing pointed blade) by a rigid cover pipe. The rigid cover pipe or sleeve is composed of two sections which can be cemented into the borehole, whereby the section of the cover pipe which is disposed in the deepest end, base or toe of the borehole is respectively force-locked or effectively connected to the anchor shank and the second or remaining section of the cover pipe.

Accordingly, when assembling a stabilizer according to my invention, a steel pipe or similar member which is adapted to perform the functions of the cover pipe and which has a sufficiently or effectively large enough surface contact area, is slid over an anchor rod or similar member. Of course, one may also introduce the anchor rod into the steel pipe. It is important that the anchor rod be installed in such a manner that the cover pipe provides an effective envelope of nearly the full length of the anchor. The inner diameter of the cover pipe is preferably only slightly greater than the outer diameter of the anchor rod, bar or similar member.

The cover pipe is composed of two sections which are connected in the manner of a butt joint, or similarly adjoin at the respective ends. The respective length of the cover pipe section which is disposed in the deepest location of the borehole or near or at the borehole base, is in accordance with customary anchoring or contact extent or distance. Thus the length can be 500 mm. The length of the other or second cover pipe section is such that the balance of the anchor positioned in the surrounding material is covered, i.e. it corresponds to the balance of the length of the anchor which is located in the rock or similar surrounding host material and can be, for example 2500 mm. or more.

The configuration of the forward end of the anchor as a positive locking or form-locking element, i.e. a blade whose shoulder abuts the innermost end of the bonding or first pipe section, prevents slipping of the anchor out of the cover pipe.

This first rigid cover pipe section which follows next to the mix end is positively connected or form-locked to the anchor member by means of an adhesive, for example an adhesive for joining or gluing metals, e.g. a liquid solder or metal-bonding adhesive. The first cover pipe section is also positively connected to the axially abutting second cover pipe section, for example by a tack weld obtained by any welding or similar technique. Upon hardening or curing of the adhesive, the full-length cover pipe is adapted to perform the function of a profiled rigid anchor or rock bolt which is fixed rigidly in place in the rock.

Upon installation into the host rock or environment, the forces acting on the cover pipe may exceed the strength or load-carrying capacity of the cover pipe and it will break or tear due to the forces acting on it, e.g. by rupture of the tack weld and separation of the two pipe sections.

The rigid armoring function of the assembly then ceases and the function of a distensible but load supporting anchor or rock bolt takes over. The possible break near the contact distance or point in the deeper portion or the base of the borehole occurs at the intended breaking point or location, namely, the tack weld.

The present invention thus provides the function of a rigid anchor and that of an extensible anchor in a sequential manner. The significant anchor length which is available for the extension and contraction under tension of the anchor presents a particular advantage. The anchor length which is available for the expansion of the anchor is practically the total length of the anchor since the length is not reduced by fastening the shank of the anchor at the borehole mouth. Accordingly, the expansion capacity and the expansion distances are considerably increased.

A good bedding, placement or embedding of the contact surface of the cover pipe or sleeve in the adhesive, cement, grout or similar composition, during the assembly is ensured because the anchor rod or bar transfers a rotating or turning motion to the cover pipe or sleeve via the first section. This is achieved by the cementitious connection between the first or toe section of the cover pipe which is provided next to the mix end or toe end of the anchor and the anchor itself. The transfer of torque or similar forces between the two cover pipe sections is achieved by the joint at the respective abutting ends thereof. As mentioned, the joint may be provided by the tack weld.

BRIEF DESCRIPTION OF THE DRAWING

The above and other objects, features and advantages will become apparent from the following description, reference being made to the accompanying drawing, in which the sole FIGURE is a schematic representation showing in longitudinal cross section the installation of one embodiment of a rock bolt or stabilizer device in accordance with the invention.

SPECIFIC DESCRIPTION

The anchor assembly or stabilizer device is generally indicated by reference number 1 in the drawing. The term anchor is intended to include rock bolts and similar stabilizers in the context of my invention.

The anchor assembly 1 is installed in a borehole 3 and secured by a cementitious composition, grout or similar matter, generally designated by reference number 8 in the drawing FIGURE. The borehole 3 in rock 4 has a deeper end or toe end 3*a* and an opposite mouth end 3*b*.

The toe end of the anchor assembly 1 includes a mix end, blade or tip, or similarly enlarged end formation, indicated generally by the reference numeral 2. This end is providing the functions of a positive lock element whose point can pierce a grouting package and whose flat blade configuration ensures thorough mixing as the anchor is rotated.

The anchor assembly 1 includes several components which extend from the mouth end 3*b* of the borehole 3 into the tunnel or gallery. Thus, the end of a rod 20 serves for tensioning the assembly comprised of the anchor rod or similar member 20 as well as a cover, pipe or similar sleeve member 5. The anchor 20 can be made of a material having expansion characteristics or similar stressing or tensioning properties, i.e. elastic extensibility.

The tensioning arrangement includes an anchor or bearing plate 11 and a spherical or seating disk 13. Tension is applied by a nut 12 arranged on the threaded portion 15, and via a bushing or spacer 14.

The threaded portion 15 is short and fully outside of the borehole 3 so as to avoid notch stresses within the region of possible angular attitudes or deflections of the bearing plate 11 relative to the anchor 20.

The anchor 20 further includes an attachment end 16 of a noncircular cross section including two parallel surfaces to which one can attach the customary installation device for the respective complete assembly.

The full cover sleeve or pipe 5 surrounds or envelops the full length of the anchor rod 20, excepting its mixing or toe end 2. This cover pipe 5 is comprised of a first or toe section 6 and a subsequent or second cover pipe section 7 terminating near the mouth end 3*b* of the bore hole 3. The length of the toe section 6 of the cover sleeve 5 is approximately 500 mm. This section 6 is combined with the anchor rod 20 by way of a metal cement compound 9.

The pipe section 7, in turn, is connected to the toe section 6 by way of tack welding, and the respective weld point or location is indicated by reference numeral 10 in the FIGURE.

The anchor or stabilizer device 1 can be cemented into the bore hole 3 in the rock 4 by means of a so-called cartridge cement. This may be in the form of an cuter glass container or tube, and an inner glass container. The containers are broken by the bolt, and the mixing end 2 effects mixing of the respective components initially held in the containers.

I claim:

1. A stabilizer device which can be affixed in a respective borehole in mining and tunneling, said device being adapted to perform the function of a rigid profile anchor under certain stress conditions and adapted to perform the function of an expansion achor under other stress conditions, such device comprising:

an anchor member comprising a metal rod having a first end formed with a mixing element and which can be secured near the base of said borehole by a cementitious composition and a second end remote from said first end and extending out of said borehole, said anchor member being made of a material having expansion properties to perform said function of an expansion anchor;

a first rigid metal pipe section closely surrounding a portion of said rod within said borehole adjacent said first end, said first rigid metal pipe section having a surface which can be joined to the wall of said borehole by a cementitious composition and being bonded to said rod over the length of said first rigid metal pipe section; and a second rigid metal pipe section closely surrounding the rest of the length of the rod and aligned with the first section within the borehole and extending from said first rigid metal pipe section to a location close to the mouth of the borehole, said second rigid metal pipe section having a surface which can be joined to the borehole wall by a cementitious composition and being connected to said first rigid metal pipe section by a joint which yields under certain of said stress conditions.

2. The device according to claim 1 wherein said second end of said anchor member is provided with a predetermined length of screw threads for tensioning said rod with respect to rock structure in which said borehole is formed, and further including when the device is installed in the respective borehole:

a fastener with screw threads adapted to cooperatingly engage with the respective screw threads of said second end of said anchor member;

a bearing plate mounted between said fastener and said second section and bearing upon said rock structure and said second section;

a spacer disposed between said bearing plate and said fastener on said second end of said anchor member; and a spherical plate mounted between said spacer and said bearing plate on said second end of said anchor member.

3. The device according to claim 1 wherein said first section is connected to said anchor member by means of a cementitious composition for joining metallic materials.

4. The device according to claim 1 wherein abutting ends of said second section and said first section are joined by a tack weld.

5. The device according to claim 1 wherein said first and second pipe sections are cemented over their full lengths in the respective borehole.

6. The device according to claim 1 wherein said rod is of uniform circular cross section over its entire length.

7. The device according to claim 1 wherein said pipe sections have inner diameters when viewed in cross section which is slightly larger than the outer diameter of said rod.

8. The device according to claim 1 wherein said first section has a length of approximately 500 mm.

9. The device according to claim 2 wherein said mixing element is a blade for mixing a cementitious composition adapted to bond said sections to said wall.

10. The device according to claim 1 wherein said anchor member is composed of steel.

* * * * *